US005433017A

United States Patent [19]

Brauchli et al.

[11] Patent Number: 5,433,017

[45] Date of Patent: Jul. 18, 1995

[54] INTAKE FILTER FOR A HAIR DRYER

[75] Inventors: Rolf Brauchli, Chicago; Ernst Brauchli, Morton Grove; Theophil Meier, Skokie; Gerhard Meier, Glenview, all of Ill.

[73] Assignee: RBI Distributors, Inc., Skokie, Ill.

[21] Appl. No.: 926,236

[22] Filed: Aug. 6, 1992

[30] Foreign Application Priority Data

Feb. 17, 1992 [DE] Germany ..... 42 02 893.1

[51] Int. Cl.[6] ..... F26B 21/06

[52] U.S. Cl. ..... 34/82; 34/97; 34/60; 34/390; 392/383

[58] Field of Search ..... 34/96–101, 34/82, 60, 61; 392/383, 384, 385; 55/385.1

[56] References Cited

U.S. PATENT DOCUMENTS

| | | | |
|---|---|---|---|
| 4,383,377 | 5/1983 | Crafton | 34/60 |
| 4,835,879 | 6/1989 | Egelstad | 34/97 |
| 5,216,822 | 6/1993 | Madiedo | 34/97 |

FOREIGN PATENT DOCUMENTS

| | | |
|---|---|---|
| 1266232 | 5/1961 | France . |
| 2930381 | 2/1981 | Germany . |
| 2161907 | 9/1900 | Japan . |
| 270491 | 5/1927 | United Kingdom . |

*Primary Examiner*—Denise L. Gromada
*Attorney, Agent, or Firm*—Speckman, Pauley & Fejer

[57] ABSTRACT

An intake filter for a hair dryer connectable to the housing of the hair dryer comprising a screen and a retaining element in the form of a cage structure adapted to fit in a ring. The retaining element forms at least one chamber, air-permeable in an axial direction, into which fragrant spheres can be inserted.

15 Claims, 1 Drawing Sheet

INTAKE FILTER FOR A HAIR DRYER

BACKGROUND OF THE INVENTION

1. Field of the Invention

This invention relates to a ringed intake filter for a hair dryer which can be connected to the housing of the hair dryer and which has a screen serving as the filter. The screen can either be held replaceably in a ring or be made of one piece with the ring.

2. Description of the Prior Art

A filter having a screen integral with a ring is described in German Patent Disclosure DE-A-2930381. A filter having a screen replaceably held in a ring has been customary for many years and today is the most used form. The replaceability of the screen used as a filter makes its cleaning easier and permits changes in mesh density.

If the mesh density is relatively high, fewer particles are pulled through the hair dryer and correspondingly fewer dust particles are burned in the heating coils of the hair dryer. However, the amount of air conveyed suffers and the filter becomes more easily plugged. In commercially used hair dryers, a large amount of conveyed air is desired, because this shortens the drying time, as is a pleasant odor.

SUMMARY OF THE INVENTION

It is an object of this invention to convey a large amount of air while limiting dust particles through a hair dryer.

This object is attained in accordance with one embodiment of this invention by an intake filter for a hair dryer comprising a ring which can be connected to the housing of the hair dryer and having a screen connected to it serving as the filter. The ring is received in a cage-like receptacle having a separate chamber which lets air through in an axial direction and into which fragrant spheres can be placed.

Two preferred embodiments of this invention are shown in the attached drawings and are explained in the description below.

DESCRIPTION OF PREFERRED EMBODIMENTS

Figure 1:
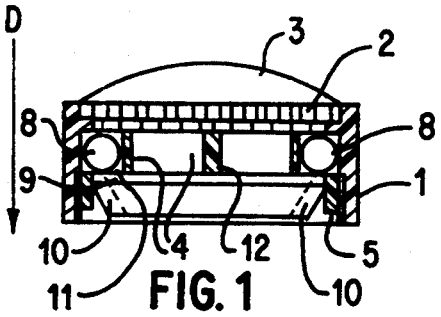
FIG. 1 is a cross-sectional view along the diameter of a filter in accordance with one embodiment of this invention.
Figure 2:
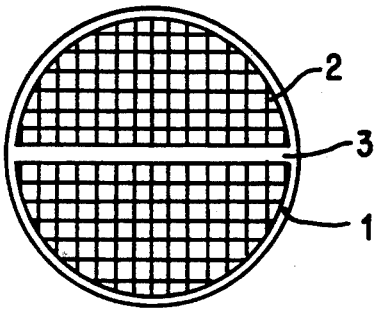
FIG. 2 is a top view of the intake filter in accordance with one embodiment of this invention.
Figure 5:
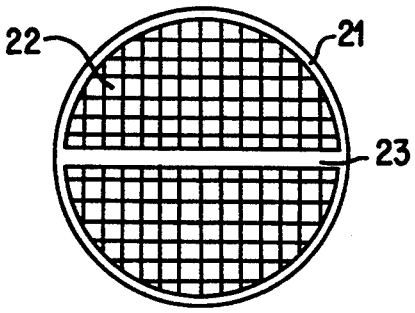
FIG. 5 is a top view of the intake filter in accordance with the embodiment shown in FIG. 4.
Figure 3:
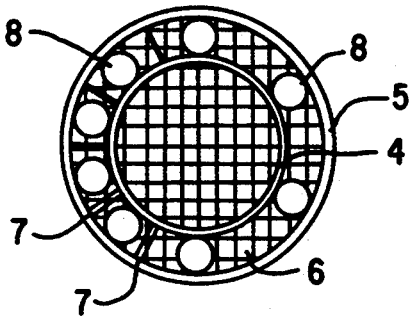
FIG. 3 is an interior top view of a ring for a filter in accordance with one embodiment of this invention, without the counter-ring, with inserted fragrant spheres.
Figure 6:
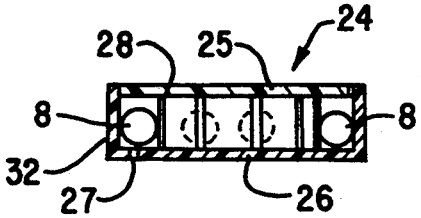
FIG. 6 is a cross-sectional view along the diameter of a retaining element for a filter in accordance with one embodiment of this invention which can be inserted in a ring.

In accordance with one preferred embodiment of this invention shown in FIGS. 1 to 3, the ring which can be connected to the housing of a hair dryer, not shown, is identified by numeral 1. The connection of the ring 1 to the housing of the hair dryer depends on the design of the hair dryer. It can be performed either with an inner and an outer thread, or with appropriate bayonet catch elements or other form closure means. However, because the type of connection has no importance for this invention, the respective fastening means have not been shown.

At the intake, the ring 1 is delimited by a screen 2, which extends flush with the upper edge of the ring 1. A transverse rib 3 across the diameter extends beyond the screen 2 and in this way not only provides stability for the ring 1, but also is used as a grip, for example, for removing or attaching the ring to the housing of the hair dryer in case there is a threaded connection.

A wall 4 which is concentric with the ring 1 is disposed underneath the screen 2 in the direction of flow D. In accordance with one embodiment of this invention, concentric wall 4 is attached directly at the bottom of the screen 2 and in this way can be connected as one piece with the ring 1 and the screen 2, as shown in FIG. 2. In accordance with another embodiment of this invention, concentric wall 4 is a part of a counter-ring 5 inserted into the ring 1. In this way a peripheral annular separate chamber 6 is created into which fragrant spheres 8 can be inserted. So that the fragrant spheres do not roll around the entire annular chamber 6, it is possible to attach a plurality of radially outwardly oriented separating walls 7 on the concentric annular wall 4, as illustrated in FIG. 3.

In the embodiment of this invention shown in FIG. 1, the concentric annular wall 4 is a part of the counter-ring 5, as already mentioned. The counter-ring 5 can also be maintained in the ring 1 by form closure or frictional connection means.

At least in the area between the concentric annular wall 4 and ring 1, the counter-ring 5 has a bottom 9 which permits an air flow to pass through. However, bottom 9 can also extend over the entire flow-through opening. The air-permeable bottom 9 can also be embodied in the form of a screen.

In accordance with the embodiment of this invention shown in FIG. 1, the counter-ring 5 is provided with a conical wall 10, slightly offset towards the inside, which is sufficiently thick so that an annular gap 11 remains between the conical wall 10 and the concentric annular wall 4, which assures an air flow. A central support tang 12 can be provided either on the screen or on the counter-ring 5 between the counter-ring 5 and the screen 2.

The disposition of the fragrant spheres along the periphery has the advantage that there is hardly any effect on the air flow and the fragrant spheres lie in a reduced air flow. No fragrances are unnecessarily released. Because the fragrant spheres are located at the inlet side of the hair dryer, the fragrances are not only intimately mixed with the air, but their effect is also additionally intensified by the heater of the hair dryer. For this reason alone, a strong air flow is not desirable in the area of the fragrant spheres.

In accordance with another preferred embodiment of this invention shown in FIGS. 4 to 7, the essential basic idea is to make the replacement of the fragrant spheres as simple as possible. To accomplish this, the retaining element is no longer formed by a concentric annular wall which is a part of the counter-ring or the ring itself, but by a separate component which, with the spheres inserted, can be directly inserted into the ring which can be connected to the housing of the hair dryer. The advantage of this embodiment is that it can be realized without changes to existing intake filters.

The ring 21, connectable to the housing of the hair dryer, corresponds to a customary ring and is also provided with a screen 22 used as a filter. In the same way as previously described, the transverse rib 23 extending across the diameter is also embodied as a grip. A cylindrical can 24 in the shape of a cage is inserted into the ring 21. The can 24 can be open at the top or closed with an air-permeable lid 25. The bottom 26 can either be air-permeable in its entirety, for example by means of appropriate perforations 27, or completely open at the center (see FIG. 7).

Figure 4:
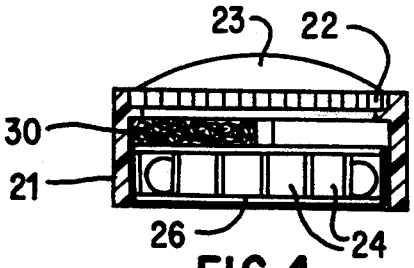
FIG. 4 is a cross-sectional view along the diameter of a filter in accordance with another embodiment of this invention, with fragrant spheres inserted.

The cylindrical can 24 in FIG. 4 is open at the top in the left half, and a hollow space in an area between the screen 22 and the can 24 is filled with a filter material. The right half of the illustration shows a variant, where the can 24 is closed off at the top with an air-permeable lid 25.

Figure 7:
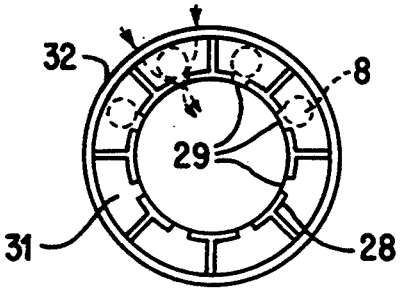
FIG. 7 is a top view of the retaining element shown in FIG. 6.

This embodiment is also shown in FIG. 7. Here, there is a concentric wall 28 in the can 24, which has inwardly directed slits 29. In this case the bottom 31 is closed in the area between the slitted annular wall 28, 29 and the ring 21. Accordingly, the air is forced to flow from the periphery towards the center, as symbolically illustrated in FIG. 7. In this case the can is actually reduced to a collar.

This embodiment also permits an almost unhindered flow in the center and a reduced flow of air over the fragrant spheres.

The collar-like embodiment of the retaining element can also be provided with a collar-like lid or end at the screen 22 of the ring 21 or on an interposed filter mat.

We claim:

1. In an intake filter for a hair dryer having a screen connected to the housing of the hair dryer and serving as the filter, the improvement comprising: a retaining element (4, 5; 24) in the form of a cage structure adapted to fit in a ring (1; 21), said retaining element (4, 5; 24) having at least one separate chamber (6), air-permeable in an axial direction, into which fragrant spheres (8) can be inserted; on an intake side, said ring (1, 21) covered with a screen (2, 22) used as a filter and integral with said ring (1, 21); and a counter-ring (5) having a screened bottom and a concentric annular wall which in an assembled state rests against the screen (2) on the intake side, disposed in said ring (1).

2. In an intake filter in accordance with claim 1, wherein said screened bottom of said counter-ring (5) air-permeably closes off an annular portion of said separate chamber (6) in the axial direction.

3. In an intake filter in accordance with claim 1, wherein in an installed position, the counter-ring (5) adjoins the concentric annular wall (4).

4. In an intake filter in accordance with claim 1, wherein the counter-ring (5) has a conical guide wall (10) inclined inwardly.

5. In an intake filter in accordance with claim 1, wherein said separate chamber (6) formed by said concentric annular wall (4) is partitioned by a plurality of separating walls (7) extending radially outward from said concentric annular wall (4) sized to receive a fragrant sphere (8) each between adjoining said separating walls (7).

6. In an intake filter in accordance with claim 1, wherein an inserted filter (30), used as a lid, is disposed between said screen (22) on the intake side and said retaining element (24).

7. In an intake filter in accordance with claim 6, wherein said inserted filter (30) is a mat of non-woven material.

8. In an intake filter in accordance with claim 4, wherein said guide wall (10) forms an annular slit adapted to permit air flow between itself and said concentric annular wall (4).

9. In an intake filter for a hair dryer having a screen connected to the housing of the hair dryer and serving as the filter, the improvement comprising:

a retaining element (4, 5,; 24) in the form of a cage structure adapted to fit in a ring (1; 21), said retaining element (4, 5; 24) having at least one separate chamber (6), air-permeable in an axial direction, into which fragrant spheres can be inserted; and said retaining element (24) fastened in said ring (21) having the shape of a cylindrical can with an air-permeable lid (25) and an air-permeable bottom (26).

10. In an intake filter in accordance with claim 9, wherein the lid (25) comprises a replaceable meshed screen.

11. In an intake filter in accordance with claim 9, wherein a plurality of peripherally disposed chambers are formed in said retaining element (24) adapted to receive at least one fragrant sphere (8).

12. In an intake filter in accordance with claim 9, wherein said bottom (26) and said lid (25) are connected to said retaining element (24).

13. In an intake filter in accordance with claim 9, wherein said retaining element (24) has a concentric annular wall (28) with at least one axial slit (29), the bottom in an area inside the annular wall (28) being open and a collar area between said annular wall (28) and a cylindrical retaining element wall (32) being closed off.

14. In an intake filter in accordance with claim 9, wherein an inserted filter (30), used as a lid, is disposed between said screen (22) on the intake side and said retaining element (24).

15. In an intake filter in accordance with claim 14, wherein said inserted filter (30) is a mat of non-woven material.

* * * * *